United States Patent [19]

Covill et al.

[11] 4,246,771

[45] Jan. 27, 1981

[54] CRIMPING TOOL HAVING DUAL PURPOSE RAM

[76] Inventors: John W. Covill, 1525 NE. 129th Pl., Portland, Oreg. 97230; Henry Larson, Jr., 36201 Enterprise Rd., Creswell, Oreg. 97426

[21] Appl. No.: 912,350

[22] Filed: Jun. 5, 1978

[51] Int. Cl.[3] ..... B21D 39/04; H01R 43/04

[52] U.S. Cl. ..... 72/326; 72/410; 29/753

[58] Field of Search ..... 72/326, 331, 335, 442, 72/453.03, 453.14, 410; 29/748, 751, 753; 83/549, 564; 30/228, 244, 249, 258, 233

[56] References Cited

U.S. PATENT DOCUMENTS

| | | | |
|---|---|---|---|
| 383,200 | 5/1888 | Schneider | 83/549 |
| 2,975,518 | 3/1961 | Nelson | 30/250 |
| 3,559,698 | 2/1971 | Smith | 29/751 |
| 3,573,625 | 4/1971 | Kindell et al. | 29/753 |
| 3,664,218 | 5/1972 | Lau et al. | 83/564 |
| 3,885,309 | 5/1975 | Lund et al. | 30/250 |
| 3,965,719 | 6/1976 | Hays | 72/410 |
| 4,091,531 | 5/1978 | Grubb et al. | 29/753 |

*Primary Examiner*—Milton S. Mehr

*Attorney, Agent, or Firm*—Klarquist, Sparkman, Campbell, Leigh, Hall & Whinston

[57] ABSTRACT

A tool having a dual purpose ram formed with a first portion to drive a knife through a cable to sever it, and a second portion to crimp a connector onto the end of the cable. The knife is made sufficiently deep in width that it will sever the cable completely even though contact between the ram and the cable by the second portion limits downward movement of the ram at the end of the severing stroke.

9 Claims, 9 Drawing Figures

FIG. 1
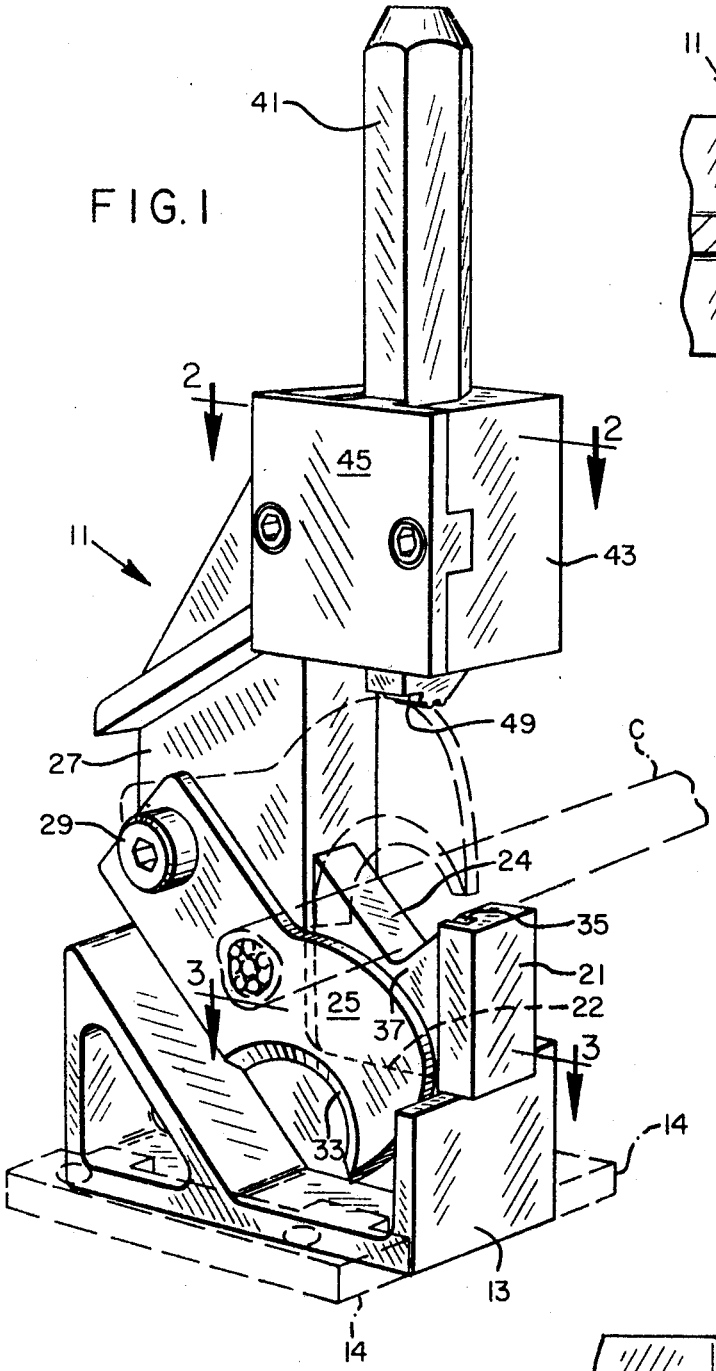
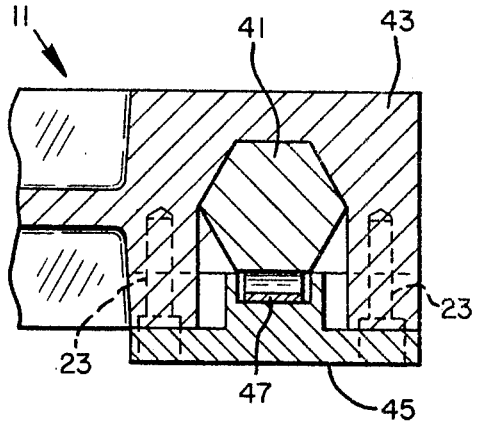
FIG. 2
FIG. 3
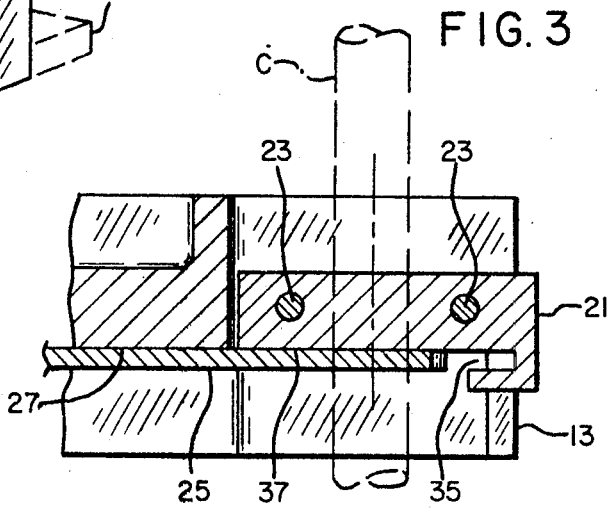

FIG. 7
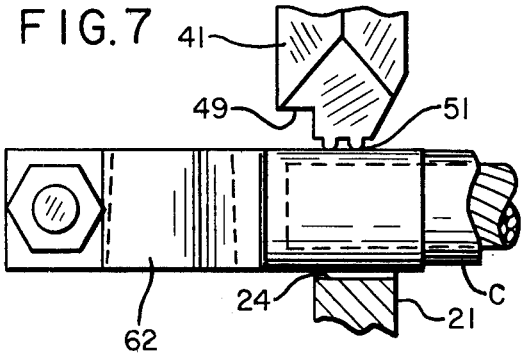
FIG. 8
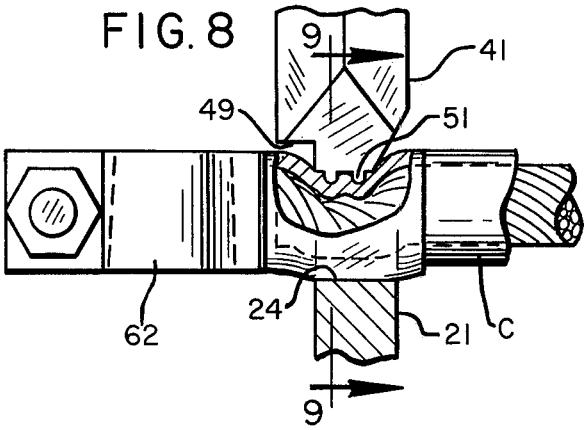
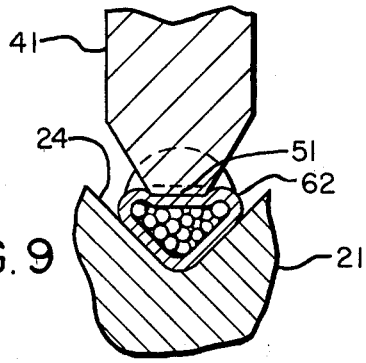
FIG. 9
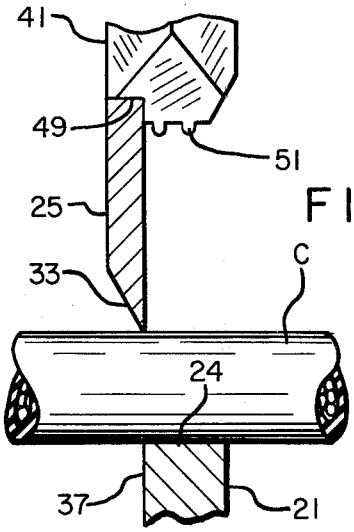
FIG. 5
FIG. 4
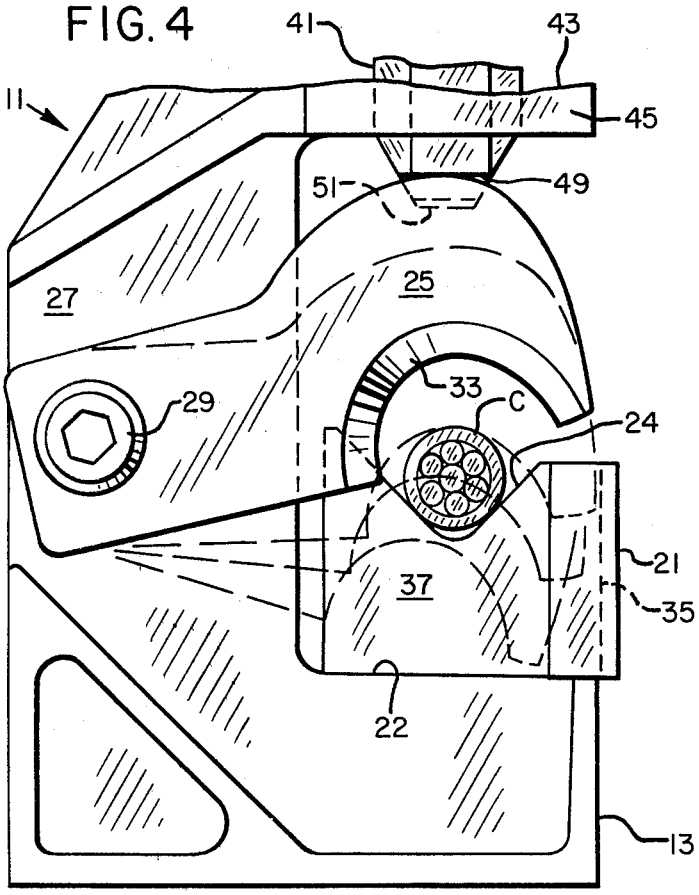
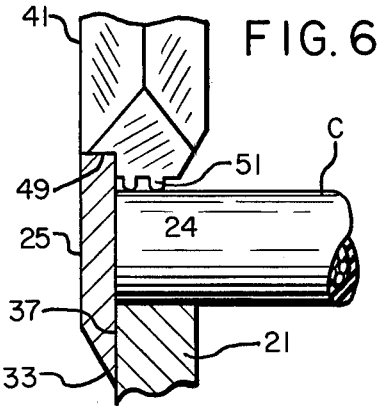
FIG. 6

CRIMPING TOOL HAVING DUAL PURPOSE RAM

BACKGROUND OF THE INVENTION

We are aware of small hand tools for severing and then subsequently crimping small diameter wires, such as 22-10 awg but we know of no single tool that is useful to sever and then crimp larger diameter wiring of cable size, such as 8-4/0 awg. At present, frequently the workmen use a pair of bolt cutters to sever the cable and then utilize a separate crimping tool for crimping a connector onto the end of the cable.

SUMMARY OF THE INVENTION

The tool of the present invention is a combination tool which can sever and then crimp cable. The tool has a single dual purpose ram and the remaining components of the tool are so designed that during a first stroke of the ram, it will drive the knife through the cable to sever it, and during a second stroke the ram will crimp a connector onto the cable. For convenience, the term "connector" will be utilized herein to mean any end member or "termination" which is to be crimped onto the end of a cable, such as, for example, a terminal, end connector, sleeve etc.

A main object of the present invention is to provide a single tool cabpable of severing a cable and crimping a connector onto the cable.

A further object is to provide such a tool that facilitates complete severing of the cable despite limiting movement of the ram caused by engagement of the crimping portion of the ram with the cable at the end of the severing stroke.

The subject matter which we regard as our invention is particularly pointed out and distinctly claimed in the concluding portion of this specification. The invention, however, both as to organization and method of operation, together with further advantages and objects thereof, may be best understood by reference to the following description, taken in connection with the following drawings, wherein like reference characters refer to like elements.

In the drawings:

FIG. 1 is a perspective view of a tool embodying the concepts of our invention;

FIG. 2 is a sectional view through the tool taken along line 2—2 of FIG. 1;

FIG. 3 is a further sectional view through the tool taken along line 3—3 of FIG. 1;

FIG. 4 is a front elevation view of the lower portion of the tool showing in broken lines the movement of the knife in severing the cable;

FIG. 5 is a fragmentary vertical sectional view through the knife and block showing the knife as it first contacts the cable;

FIG. 6 is a view like FIG. 5 but showing the cable as having been severed;

FIG. 7 is a fragmentary view like FIG. 5 but showing the ram as it first contacts the connector for the cable;

FIG. 8 is a view like FIG. 7 but showing the ram as having crimped the connector onto the cable; and FIG. 9 is a section along line 9—9 of FIG. 8.

Referring to FIG. 1, the tool includes an upright frame or body 11, which for lightness, is shown as being formed with various ribs and webs. It can be made of various materials, such as aluminum. The body has a base 13 for resting on a supporting surface. A pair of retaining strips 14 can be bolted to the surface to hold the tool in place.

The frame 11 supports a cutting and crimping block 21 of hard tool steel, the block being secured on a shelf portion 22 of the frame by a pair of bolts 23 (FIG. 3) which pass through bores in the underside of the base and thread into the block.

The block has an upper V-shaped operating face 24 to receive and support a cable C to be cut, or to support a connector and cable for crimping purposes.

To perform the cutting function, we provide a tool steel knife or blade 25, which is pivotally mounted on an upright portion 27 of the frame 11 by means of a shoulder bolt 29 which functions as a pivot for the knife. The free end portion of the knife is formed with a curved notch portion which is beveled to provide a curved knife edge 33 to cut through and sever the cable.

The block 21 is also formed with a guide 35 which provides a vertical groove of a size to slidably receive the free end of the knife 25 to hold the knife close to a vertical cleaving face 37 of the block 21 during the cutting step.

To drive the knife through a cable, we provide a dual purpose tool steel ram 41 which is mounted for vertical movement by having a sliding fit in a head portion 43 of the frame. The ram is of non-circular cross section (shown as being of hexagonal cross sectional shape) to have a nonrotatable fit in the head portion 43. A cover 45 is detachably bolted to the head portion and carries a spring 47 (FIG. 2) to frictionally engage the ram and hold it in any position to which it is moved, and particularly in its raised or elevated position.

As shown in FIG. 5, the lower end of the ram is formed with a notch providing shoulder 49 to ride on and engage the upper flat edge of the knife 25.

The cutting operation is as follows: the ram is raised to an upper position to allow the knife to be raised, whereafter a section of cable C is placed in the V notch 24 of the block with an end portion projecting from the block. Then a sharp blow is delivered to the upper end of the ram by means of a hammer or other suitable tool to drive the ram downwardly and thus drive the knife 25 through the cable to effectively sever it.

The ram has a crimping portion 51 on its lower end laterally offset from the shoulder surface 49, but in alignment with the block 21. At the end of the cutting stroke, this crimping portion will engage the cable on the block 21 to limit further downward travel of the ram.

However, the free end portion of the knife is made sufficiently deep (or wide if viewed in plan) so that even though the ram movement is stopped by the engagement of the crimping portion with the cable, the lower cutting edge at this time will have passed completely through the cable and beyond the lowermost portion of the V notch on the block 21 to completely sever the cable, as shown in FIG. 6.

Then the insulation at the cable end is stripped to provide a bare end portion. Then the ram is raised to allow a connector or other similar element to be fitted on the bare end of the cable and the fitted cable end again deposited in the V notch (FIG. 7). Now the ram is again driven downwardly by striking the upper end thereof to drive the crimping end portion 51 into the connector (identified by the reference numeral 62) and firmly and effectively crimp it to the cable (FIGS. 8 and 9).

While the term "cable" has been used in the specification and claims, the invention is not intended to be limited to electrical cable and has application to a wide variety of other elongate items and materials which can be cut and crimped, regardless of cross sectional shape. Thus, the term "cable" as used in the claims is intended to include such elongate items and materials.

We claim:

1. A severing and crimping tool for cables comprising a frame having a vertical guideway, a ram non-rotatably, slidably fitting in said guideway, a knife constituting an element separate from said ram, a stationary member having a recess located below and in alignment with said ram and adapted to hold the cable to be cut and thereafter a connector to be crimped, means mounting said knife on said frame independently of said ram and in spaced relation from said ram for movement of said knife from an upper position to a lower position along a predetermined path coinciding with a portion of said ram, means on said ram whereby said ram may be actuated to engage said knife for cutting the cable and for subsequently crimping a connector onto the cable, said ram being configured on its working end for direct indentation into a connector surrounding a cable portion.

2. A tool as recited in claim 1 in which said knife is mounted at one end on a fixed stationary portion of said frame for pivotal movement about a stationary axis perpendicular to a plane containing said predetermined path.

3. A tool as recited in claim 2 in which said knife extends generally horizontally from its pivotal axis toward said stationary member and has a curved cutting edge at the end portion thereof remote from its pivotal axis, said knife having a blunt edge for abutting engagement with said ram, said blunt edge, in the lower position of said knife, being disposed below said recess.

4. A tool as recited in claim 3 in which said ram has a notched operating end providing a shoulder for engaging said blunt edge of said knife to drive the same, and has a crimping portion aligned with said stationary member for crimping purposes.

5. A tool as recited in claim 4 wherein the dimension of said knife between its cutting edge and its blunt edge is sufficiently great as to facilitate complete severing of a cable despite movement-limiting engagement between said crimping portion and said cable at the end of said severing step.

6. A severing and crimping tool for cables comprising a frame, a knife mounted on the frame for movement in a predetermined direction, a stationary member to hold the cable to be cut, a ram for actuating the knife and for crimping a connector onto the cable, and a guide for an end portion of said knife to hold it in a predetermined cutting plane during the severing step, said ram being configured on its working end for direct indentation into the portion of the cable surrounded by the connector.

7. A tool as recited in claim 6, in which said guide is an integral part of said stationary member.

8. A tool as recited in claim 7 in which said stationary member comprises a block having a V-shaped supporting surface for a cable or connector equipped cable.

9. A tool as recited in claim 8 in which the cutting edge of said knife is concavely arcuate and the parts are so dimensioned that the most indented point of said cutting edge substantially coincides with the most indented point on said V-shaped surface during the severing step.

* * * * *